US005937589A

United States Patent [19]

Fischer

[11] Patent Number: 5,937,589

[45] Date of Patent: Aug. 17, 1999

[54] ROD JOINTS

[75] Inventor: Klaus Fischer, Talheim, Germany

[73] Assignee: Helmut Fischer GmbH, Talheim, Germany

[21] Appl. No.: 08/894,152

[22] PCT Filed: Feb. 13, 1996

[86] PCT No.: PCT/DE96/00225

§ 371 Date: Dec. 11, 1997

§ 102(e) Date: Dec. 11, 1997

[87] PCT Pub. No.: WO96/25568

PCT Pub. Date: Aug. 22, 1996

[30] Foreign Application Priority Data

Feb. 15, 1995 [DE] Germany ..... 295 02 486 U

[51] Int. Cl.[6] ..... E04B 1/32

[52] U.S. Cl. ..... 52/81.3; 52/236.2; 52/223.1; 52/81.1; 52/665; 52/DIG. 10; 403/176; 403/218

[58] Field of Search ..... 52/236.2, 223.1, 52/80.2, 81.1, 82, 81.2, 81.3, 86, 665, DIG. 10; 403/217, 218, 172, 176, 219

[56] References Cited

U.S. PATENT DOCUMENTS

| | | | |
|---|---|---|---|
| 3,635,509 | 1/1972 | Birkemeier | 287/189.36 C |
| 3,909,994 | 10/1975 | Richter . | |
| 3,950,901 | 4/1976 | Sumner . | |
| 3,994,106 | 11/1976 | Groser et al. | 52/225 |
| 4,244,152 | 1/1981 | Harper, Jr. | 52/81 |
| 4,698,941 | 10/1987 | Rieder et al. | 52/81 |

FOREIGN PATENT DOCUMENTS

| | | |
|---|---|---|
| 682 854 | 6/1930 | France . |
| 8 600 724 | 10/1987 | Netherlands . |

*Primary Examiner*—Christopher Kent
*Assistant Examiner*—Yvonne Horton-Richardson
*Attorney, Agent, or Firm*—Jones, Tullar & Cooper, P.C.

[57] ABSTRACT

A rod joint serves as a construction element of a load-bearing structure for supporting a glass wall or glass roof. A plurality of rods are joined together in the joint by a screwed tab connection. The rod joint (10) is distinguished in that the rods (12–22) abut one another, pressing nonpositively against one another, with their end regions each via at least one end face region and that the end regions of the rods, located in the joint are held, screwed together between two cover disks.

7 Claims, 2 Drawing Sheets

FIG. 2
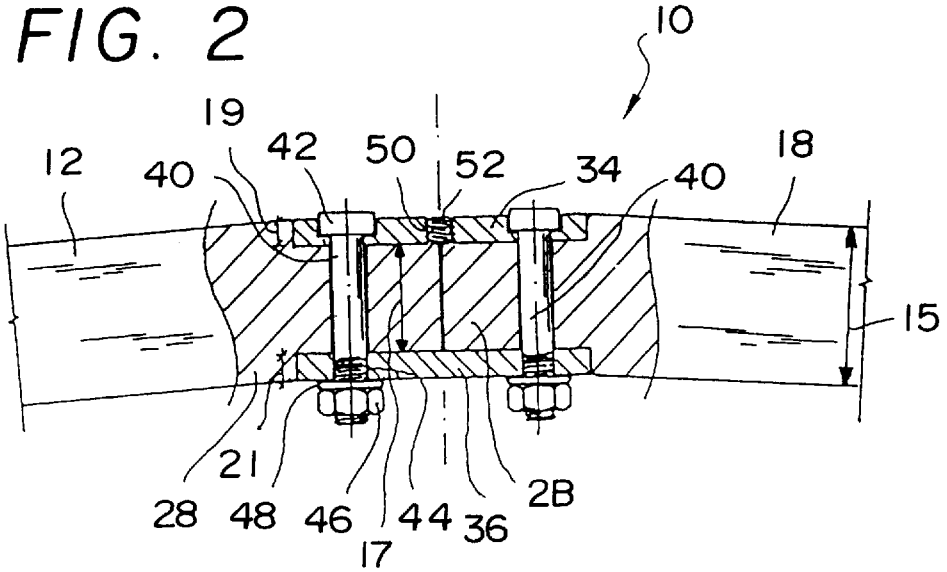
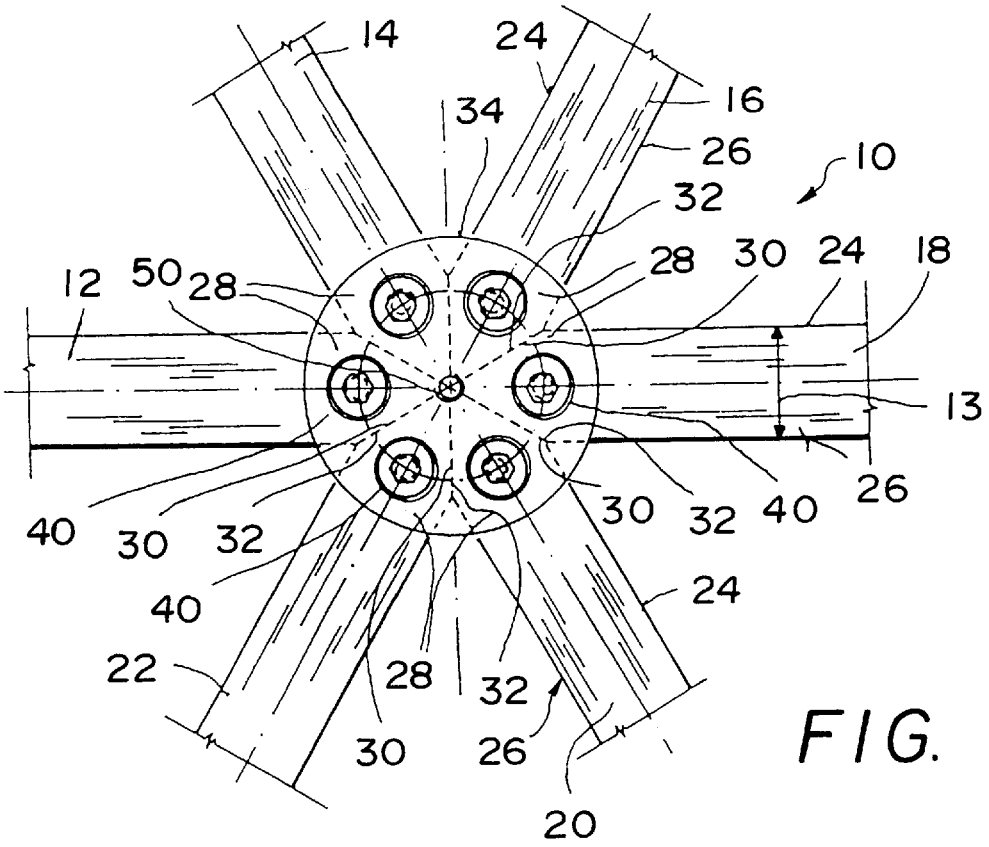
FIG. 1

ROD JOINTS

FIELD OF THE INVENTION

The present invention relates to a rod joint as a construction element in a load-bearing structure. The load-bearing structure serves to support a glass wall or glass roof. The glass wall or roof is composed of many individual panes of glass that are secured in mutual spacing on the load-bearing structure. Glass walls or glass roofs of this kind are used to glass over large areas of building or construction components.

STATE OF THE ART

Known rod joints of the type referred to at the outset are in the form of two rods intersecting one another at right angles or skewed angles. The panes of glass to be secured on such a basic construction have a suitable quadrilateral shape (rhomboid, square or rectangular). In the case of flat load-bearing structures or areas to be glassed over, or a load-bearing structure that is curved in only one direction that is to be covered with glass plates, no structural difficulties arise; the individual panes of glass can be supported and secured, abutting one another at appropriate angles, on the load-bearing structure that correspondingly is curved in a single plane in space. However, glazing surfaces curved in two planes in space present problems, since the intrinsically flat panes of the glass panel then do not rest with their corners simultaneously on all four joints. Where curvatures are slight, the attempt is made to install the glass panes in an elastically deformed way. Where there are problems of greater curvature, suitably predeformed panes, or panes broken along a cracking line, can be used.

SUMMARY OF THE INVENTION

Based on this prior art, it is the object of the present invention to provide a way of glazing large-area load-bearing structures, arbitrarily curved in space, without problems.

The invention is characterized in that the rods abut one another, pressing nonpositively against one another, with their end regions, each via a at least one end face region. The end regions of the rods, located in the joint are held, screwed together, between two cover disks. Based on the rod joint known in the prior art, in each of which a plurality of rods can be joined together by a screwed tab connection, the rod joint of the present invention is distinguished in that the rods abut one another by their end regions, each via at least one end face region, exerting pressure nonpositively on one another, and are held screwed together in their end regions, and thus in the region of the rod joint, between two disks. In this embodiment, the pressure forces are transmitted by planar contact between abutting rods. Tensile forces, conversely, are transmitted via the disks screwed together and covering the abutting region on both sides. Bending forces can also be well transmitted. For instance, the tensile and pressure forces arising when a bending moment is broken down, can be transmitted in the way described above in the rod joint either—in the case of tensile forces—by one or the other disk—or in the case of pressure forces—by the end face regions of the abutting plurality of rods.

It has proved advantageous for the end regions of the rods abutting one another at a joint to be embodied with end face regions that taper toward the end. Adjacent rods then abut one another by these end face regions. The structural height in the region of the joint can be kept low as a result.

The fewer the rods that meet at one joint, the slenderer the load-bearing structure proves to be. In joints with four rods, the areas to be covered by panes of glass between the joints are quadrilateral. Since the rods in the region of a joint can meet at different inclinations, the panes of glass can be flat.

The trestle-type construction can also be embodied such that the rod joints enclose triangular areas. Then panes of glass of triangular outline can be used in the glass panel. In each case, one rod of the load-bearing structure is present under each free edge of the pane of glass. Arbitrarily curved load-bearing structures can thus be formed and glassed over. Depending on given requirements, the angles between adjacent bars are preferably in the range from greater than 0° to less than 180°. In such a construction, the loads transmitted can still be well transmitted to the various other rods connected.

In order not to have to make the load-bearing structure structurally too high, it has proved to be appropriate for one or both disks to be more or less markedly countersunk in the end regions of the rods. As a result, the screw heads passing through them do not collide with the panes of glass that cover the rods and rod joints from above.

The end regions of the rods can meet in a joint at arbitrary angles. The joints of a load-bearing structure are therefore often not embodied structurally identically to one another. Hence the production-related demands made of the embodiment of the components present at a joint are extremely stringent. These demands can be feasibly met virtually only by using computer-supported construction. To make it possible for the basic line grid in the computer to be converted correctly and simply into a grid of rod joints, it has proved to be appropriate to dispose the line grid in the middle of the top face of the individual rods. These grid lines or system lines then each abut at one point of each joint. From this theoretical node point, the joint is then constructed "from the top down". To meet the static requirements appropriately, the disks are countersunk as needed far enough into the ends of the rod that a predetermined spacing always exists between them. Since the disks also have the same thickness and design in each joint, suitable computer preconditions can thus be made the basis for all the joints.

The glass panel for this kind of load-bearing structure can comprise a single pane, or a single or insulating sheet of glass made up of a plurality of panes. The panes of glass may also be replaced with nontransparent plates. A glass panel in which a cover plate that additionally acts from outside is pressed onto the upper disk has proved to be a structurally simple and technically fully satisfactory embodiment. The edges of the pane of glass are thus press-fitted in between two disks in the region of the joint. One of the disks is the cover disk present in the structural embodiment of the joint. The other disk is additionally present on the outside of the glass panel. This additional disk can be secured in a structurally simple way to the outer disk via a screw connection.

Further advantageous features and embodiments of the present invention can be present from the exemplary embodiment discussed below.

BRIEF DESCRIPTION OF THE DRAWING

The present invention will be described in further detail below in terms of the exemplary embodiment shown in the drawing. Shown are:

FIG. 1, which is a plan view on a rod joint of the present invention;

FIG. 2, which is a side view, partly in section, of the rod joint of FIG. 1.

DESCRIPTION OF THE PREFERRED EMBODIMENT

Figure 3:
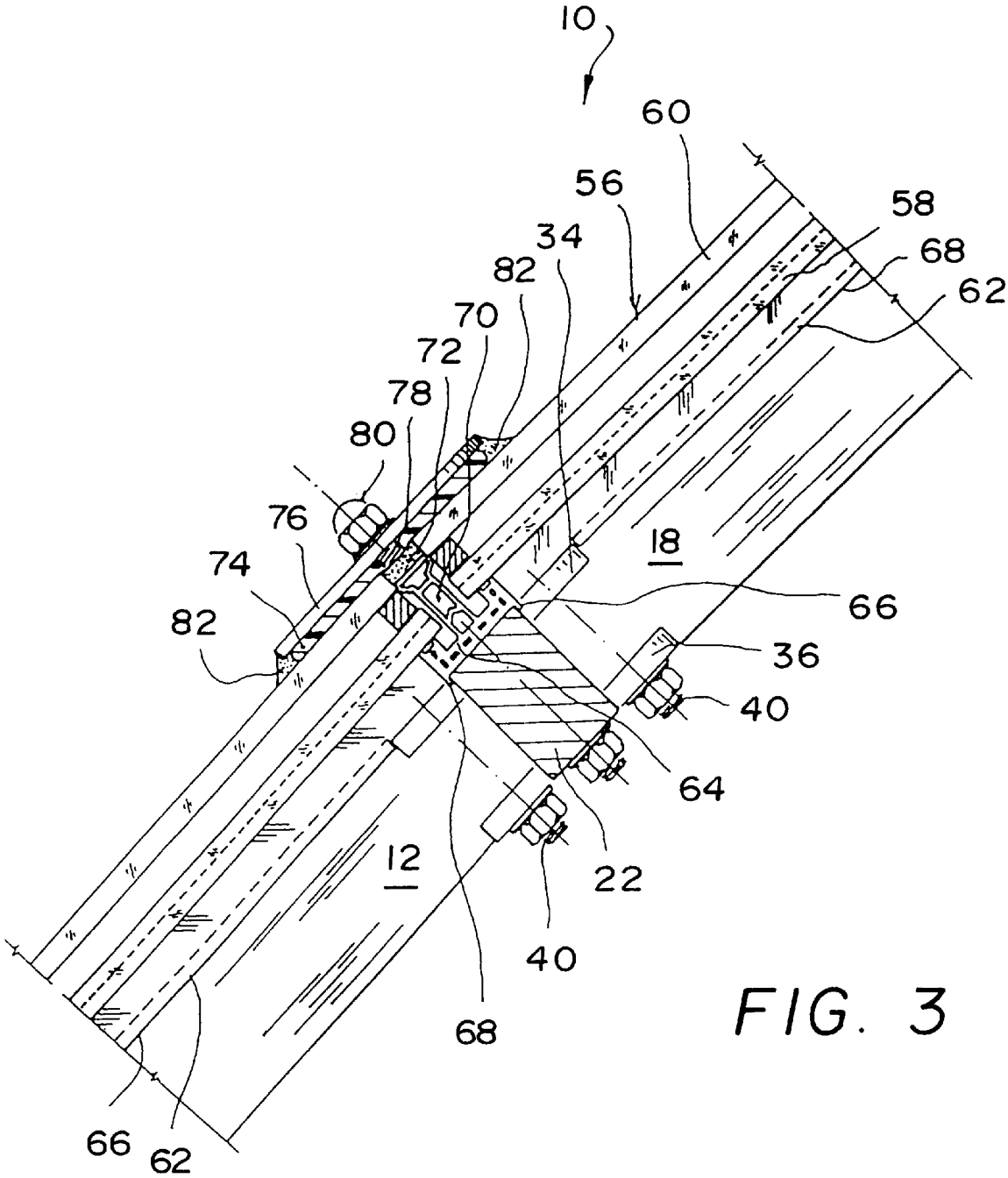
FIG. 3, a side view, partly in section, of a rod joint provided with a glass panel.

In a rod joint 10 shown in FIG. 1, in the present example six rods 12, 14, 16, 18, 20, 22 abut one another. The rods are part of a load-bearing structure. The joints can then be present inside the load-bearing structure in such a way that the rods connecting the joints frame triangular areas. These faces may also be quadrilateral, for instance trapezoidal areas.

Each of the rods 12–22 comprises a rectangular profile, in the present example with a width 13 of 40 mm (millimeters) and a height 15 of 60 mm. The two side faces 24, 26 converge at an acute angle on one another in the respective end region 28 of the applicable rod. As a result, each rod 12–22 has two oblique end face regions 30, 32 converging at an acute angle. Adjacent rods, for instance the rods 18 and 16, rest in planar fashion on one another with their adjacent end face regions 30, 32. This is true for all the rods and all the end face regions of the various rods in one rod joint. In this way, pressure forces can be transmitted to adjacent rods of a rod joint 10 by contact via the end face regions 30, 32.

The end regions 28 of the rods 12–22, inside the rod joint 10, have a reduced rod height 17, of 40 mm in this example, compared with the remainder of the rod region. One cover disk 34 protrudes from above and one cover disk 36 protrudes from below into the thus-formed two regions 19, 21 of lesser height. These two cover disks 34 and 36 are held together, screwed together by a threaded bolt 40, in the region of each end region 28 of the abutting rods. The threaded bolts may be prestressed. The heads 42 of the bolts 40 are disposed countersunk in the upper cover disk 34. The bolt 40 protrudes downward out of the lower cover disk 36. A nut 46 is screwed onto the male thread 44 that can be seen there. This nut 46 rests firmly via a washer 48 against the cover disk 36. A male thread 44 is present on the threaded bolt 40 in such a way that it ends within the lower cover disk 36 and does not reach into the region of the end face regions 30, 32. The cover disks 34, 36 are fitted so accurately into the two lesser-height regions 19, 21 that pressure forces can also be transmitted into these two regions. For the transmission of pressure forces, a cross-section is therefore available, even in the weakened end region 28 of each rod, that is comparable to the unweakened rod cross section. Because of the countersunk disposition, both the upper cover disk 34, and the screw heads 42 in the cover disks 34 can be practically flush with the top-facing side of the disk.

There is a central bore 50 with a female thread 52 in the top cover disk 34. A screw 78 can be screwed into this female thread 52 from above, as will be described in detail below.

A glass panel 56 rests on the rod joint 10 shown in FIGS. 1 and 2. In the present example, this glass panel comprises an insulating glass panel 56, which is composed in the usual way of a lower pane 58 and an upper pane 60 spaced apart from it. This glass panel 56 rests on sealing profiles 62, 64. These sealing profiles 62, 64 cover the top sides of the rods 12–22 and with downward-projecting tabs 66, 68 they reach around the upper two longitudinal edges of the rods. The sealing profiles 62, 64 have a centrally upward-protruding projection or strut 70. This strut 70 protrudes upward through the end or side faces of the glass panels 56. A sealing composition 72 is seated from above on the strut 70 and forms a watertight connection between the upper panes 60 in the plane of the upper pane 60.

In the region of each joint and hence including the joint 10, the glass panel 56 and hence the top pane 60 are covered from above by a silicone disk 74. An outer disk 76 rests from above on this disk 74. The disks 74, 76 have a central recess, through which a screw 78 extends from outside; it is screwed into a central female thread 52 of the upper cover disk 34. The screw 78 does not touch the end regions 28 of the rods that meet in the rod joint 10. This screw 78 is covered from the outside, for instance by a cap nut 80. A sealing composition 82 that surrounds the outer disk 74 forms a watertight connection between the outer disk 74 and the top panes 60 of the glass panel 56 in the region of the joint 10. Given a correspondingly differently inclined alignment of the rod joints in space, the rods between adjacent rod joints 10 must be installed twisted.

This construction of the rod joint 10 makes a considerable transmission of tensile, pressure and moment forces possible. The glass panel 56 rests without force on the rod joints. At the same time, the waterproofness of the construction is assured. The bending strength of the rod joints, which is approximately 60% of the strength of the rods used, is very high. As a result, for the first time, rods with a width of only 40 mm can be used. The load-bearing structure thereby gains a very slender appearance.

Because of the triangular outline of the individual panes of the glass panel 56, arbitrarily curved areas of glass can be formed. The various individual panes of the glass panel are flat. Because of the variable alignment in space of the rods that meet at one rod joint, the end face regions 30, 32 of the individual rods are not necessarily oriented at right angles to the top or bottom side of the applicable rod. In general, each rod will have end face regions 30, 32 that differ in their angular alignment from the corresponding end face regions of adjacent rods.

I claim:

1. A rod joint for connecting glass structures, comprising:

a plurality of rods, each rod having an end region of lesser height than the remainder of the rod, each end region defining a pair of end faces;

two cover disks; and a plurality of threaded bolts, wherein:

said plurality of rods are joined together at their end regions such that said end faces are in abutment and form thereby upper and lower countersunk areas of lesser height;

said two cover disks being situated in a respective one of said upper and lower countersunk areas of lesser height defining a mutual fixed spacing, said plurality of threaded bolts extending through each of said two cover disks and apply a force to said two cover disks which in turn apply a pressing force against said plurality of rods in said countersunk areas producing a force-locking of said abutting end faces.

2. The rod joint as defined in claim 1, wherein said end faces of each rod are tapered.

3. The rod joint as defined in claim 1, wherein four rods are provided.

4. The rod joint as defined in claim 1, wherein six rods are provided.

5. The rod joint as defined in claim 1, wherein the glass structures include an insulating pane of glass.

6. The rod joint as defined in claim 1, further comprising:

an additional outer disk; and a screw, wherein a glass structure is held in a clamping fashion between said two cover disks and a further glass structure is held between one of said cover disks and said additional outer disk by said screw, and wherein a sealing profile is present between adjacent free ends of the glass structure, the sealing profile being present between the glass structure and said additional outer disk.

7. The rod joint as defined in claim 1, wherein said rods are solid-material rods with a maximum width of 40 mm and a maximum height of 60 mm.

* * * * *